United States Patent [19]

Kästele et al.

[11] Patent Number: 5,021,263

[45] Date of Patent: Jun. 4, 1991

[54] AQUEOUS TEXTILE TREATMENT AGENT AND CREASE RESIST FINISHING OF TEXTILE MATERIAL

[75] Inventors: Xaver Kästele, Neusäss; Michael Bernheim, Aystetten; Erich Rössler, Stadtbergen, all of Fed. Rep. of Germany

[73] Assignee: Ciba-Geigy Corporation, Ardsley, N.Y.

[21] Appl. No.: 526,193

[22] Filed: May 21, 1990

Related U.S. Application Data

[63] Continuation-in-part of Ser. No. 316,126, Feb. 27, 1989, abandoned.

[30] Foreign Application Priority Data

Mar. 4, 1988 [DE] Fed. Rep. of Germany ..... 3807030

[51] Int. Cl.[5] ..... B05D 3/02

[52] U.S. Cl. ..... 427/353; 8/181; 8/185; 8/189; 252/8.9; 427/393.2

[58] Field of Search ..... 8/181, 185, 189; 427/353, 393.2; 252/8.9

[56] References Cited

U.S. PATENT DOCUMENTS 4,300,973 11/1981 Bezwada ..... 427/405 X 4,770,668 9/1988 Skoultchi et al. ..... 8/189 X 4,964,872 10/1990 Ikeda et al. ..... 8/189 X

OTHER PUBLICATIONS

Chem. Abstr. 99(24): 196609s, corresponds to JP58/87367.

Chem. Abstr. 99(24): 196610k, corresponds to JP58/87367.

Chem. Abstr. 102(4): 26301y, corresponds to JP51/055499.

Derwent Citation No. 76415x/41, corresponds to JP51/055499.

*Primary Examiner*—Michael Lusignan

*Attorney, Agent, or Firm*—George R. Dohmann; Edward McC. Roberts

[57] ABSTRACT

An aqueous textile treatment agent is based on 1,3-dialkyl-4,5-dihydroxy-imidazolidinones and selected polyhydric alcohols, in particular 1,6-hexanediol or 1,1,1-tris(hydroxymethyl)-ethane and is used for the formaldehyde-free finishing of textile material which consists at least partly of cellulose or regenerated cellulose fibers in order to confer crease and shrink resistance thereon, the textile material so treated being notable for appreciably improved whiteness, compared with the prior art, as well as good crease and shrink resistance.

13 Claims, No Drawings

AQUEOUS TEXTILE TREATMENT AGENT AND CREASE RESIST FINISHING OF TEXTILE MATERIAL

This application is a Continuation-in-Part of Ser. No. 07/316,126 filed Feb. 27, 1989, now abandoned.

The present invention relates to aqueous textile treatment agents based on 1,3-dialkyl-4,5-dihydroxyimidazolidinones and selected polyhydric alcohols. They are used for the formaldehyde-free finishing of textile material which consists at least partly of cellulose or regenerated cellulose fibers in order to confer crease and shrink resistance thereon.

The crease resist finishing and the easy care finishing and improvement of the wet stability of cellulose-containing textile material has been known for a long time. Most of the products used for this purpose are based on addition products of formaldehyde on urea and/or melamine and on derivatives thereof. These addition products are applied to the textile material in the form of an aqueous solution together with a suitable catalyst, dried and cured on the fiber to give aminoplast resins. The disadvantage of these existing processes is that at various stages, in particular during drying, during curing and even during the storage of the finished textile material, formaldehyde is eliminated, so that special measures, for example effective aspiration during drying and suitable treatment of the waste air or washing following curing, need to be employed to remove substantially all the undesirable free formaldehyde.

There has been no shortage of attempts to obtain crease resistance by replacing the aminoplast intermediates (=addition products of formaldehyde on urea, melamine and/or on derivatives thereof) with products which cannot give off formaldehyde. 1,3-Dimethyl-4,5-dihydroxyimidazolidinone was proposed for this purpose many years ago (U.S. Pat. No. 3,112,156). However, the cotton fabrics treated in accordance with this proposal exhibited strong yellowing. According to two further proposals (Japanese Patent Applications 58/87367 and 58/87368, abstracted in C.A. 99 (24):196 609 s and 196 610 k, 1983), the whiteness is improved by adding polyethylene glycol polypropylene glycol, ethylene glycol or diethylene glycol to the finishing liquors. Finally, there is a further known process where 1,3-dimethyl-4,5-dihydroxyimidazolidinone is used together with glycerol (Japanese Patent Application 59/116,476; abstracted in C.A. 102 (4): 26 301 y). If these proposals are carried out, however, it is found that the desired effect, namely the improvement in whiteness, is obtained only to an unsatisfactory degree, as will be shown in the comparative examples.

It is an object of the present invention in the finishing of cellulose containing textile material with 1,3-dialkyl-4,5-dihydroxyimidazolidinones to avoid or at least decisively reduce the yellowing of the textile materials treated with these imidazolidinones. We have found, surprisingly, that this object is achieved by using very specific selected polyhydric alohols.

The present invention accordingly concerns aqueous textile treatment agents containing effective amounts of a 1,3-dialkyl-4,5-dihydroxyimidazolidinone, whose hydroxyl groups may be wholly or partly etherified with low alcohols and 2-methyl-2,4-pentanediol or a polyhydric alcohol of the general formula $$RCH(OH)—(CH_2)y—CH(OH)—R' \qquad \text{I a)}$$

where R and R' are independently of each other H or $CH_3$ and y is from 1 to 4 and/or $$R''—C(CH_2OH)_3 \qquad \text{I b)}$$

where R'' is alkyl with 1 or 3 carbon atoms, wherein the said imidazolidinones may also be at least partly etherified with the polyhydric alcohols of the formulae I a) and/or I b). In a particular embodiment, the finishing agents additionally contain water-soluble epoxy-containing hydrophilic silicones. The finishing agents contain in general between 35 and 80% of active substances, active substances to be understood as meaning the imidazolidinones, polyhydric alcohols and any hydrophilic silicones additionally present. In addition, the present invention concerns a process for the crease resist finishing of textile material which consists at least partly of cellulose or regenerated cellulose using the textile treatment agents mentioned. The 1,3-dialkyl-4,5-dihydroxyimidazolidinones mentioned and ethers thereof with low alcohols (from 1 to 4 carbon atoms) are known and may be prepared for example as described in EP Patent Application 141,755 or U.S. Pat. No. 3,260,565. Because it is simple to prepare, 1,3-dimethyl-4,5-dihydroxyimidazolidinone is preferred. Particular preference, however, is given to reaction products of dialkyldihydroxyimidazolidinones where the dihydroxy group have been wholly or partly etherified with alcohols. Suitable for this purpose are on the one hand low alcohols of from 1 to 4 carbon atoms, and on the other in particular the polyhydric alcohols of the formulae Ia) and Ib). The etherification has the effect that the imidazolidinones become more soluble in water, which is important in particular for providing highly concentrated textile treatment agents. Otherwise, solids would tend to settle out. The hydroxyl groups in the 4- and 5-positions may be wholly etherified with the alcohols mentioned. However, it is usually sufficient to obtain partial etherification, since this objective is achieved even with partial etherification, depending on the monohydric or polyhydric alcohol used. The etherification may be carried out by the method described in previously cited U.S. Pat. No. 3,260,565.

As briefly mentioned, the treatment of cellulose-containing fiber material to confer crease resist properties thereon with dialkyldihydroxyimidazolidinones in the presence of customary catalysts with or without prior art polyhydric alcohols gives rise to the problem of substantial yellowing of the fiber material on heating. In the case of dyed goods, the use of zinc salts as catalysts in particular gives rise to distinct shifts in hue. This heating is absolutely necessary to obtain the desired crease and shrink resistance and also as part of further treatment steps. Relatively slow-reacting imidazolidinone requires temperatures of up to about 180° C. or more (cf. for example U.S. Pat. No. 3,260,565). For industrial application it is therefore decisive that the whiteness of the goods after heating corresponds as much as possible to the whiteness of the goods treated with the customary aminoplast intermediates, for example with 1,3-dimethylol-4,5-dihydroxyimidazolidinone.

As is apparent from the above account of the prior art, various polyhydric alcohols have been proposed for the same purpose, namely the improvement of whiteness, but without significant success. The choice of the right polyhydric alcohol is of crucial importance to the invention. Especially in the light of the various unsuccessful prior art proposals, it was not foreseeable that the choice of very specific polyhydric alcohols would make it possible to obtain further, decisive advances in this matter.

The polyhydric alcohols selected according to the invention are those of the general formulae:

$$RCH(OH)—(CH_2)y—CH(OH)—R' \quad Ia)$$

where R and R' are independently of each other H or $CH_3$ and y is 1 to 4 and $$R''—C(CH_2OH)_3 \quad Ib)$$

where R'' is alkyl with 1 or 3 carbon atoms. Besides, 2-methyl-2.4-pentanediol may be used. For the purpose of the present invention it is of course also possible to use mixtures of the aforementioned compounds of the formulae I a) and I b).

Of the polyhydric alcohols of the general formula I a) in particular 1,6-hexanediol is suitable. 2-methyl-2,4-pentanediol is also suitable. It is not known why these two alcohols are exceptionally advantageous.

Of the second group of polyhydric alcohols—formula I b—1,1,1-tris(hydroxymethyl)ethane deserves to be singled out. The effectiveness of this compound is particularly surprising since the close relative glycerol gives distinctly poorer results. It is also noteworthy in this context that for example 1,2,6-hexanetriol produces virtually no improvement in whiteness. This shows how strict the selection had to be in order to achieve the stated object.

Of all the above mentioned polyhydric alcohols selected according to the invention, 1,6-hexanediol is particularly preferred.

The selected polyhydric alcohols are used in amounts of from about 10 to 80, in particular 30 to 60% by weight, based on the dialkyldihydroxyimidazolidinone used, calculated as solids.

The imidazolidinone is generally used in the finishing liquors in amounts of 40 to 120 g/l, in particular in amounts of from 60 to 100 g/l (calculated as solids).

The curing on and/or crosslinking to the fiber, besides high temperatures, also requires a catalyst. Of the catalysts generally customary for this purpose, magnesium salts, in particular magnesium chloride are preferred, magnesium chloride being preferably used together with acetic acid or citric acid (possibly partially neutralized) or together with fluoroborates, such as sodium fluoroborate or potassium fluoroborate, which have a boosting effect. In principle it is also possible to use zinc salts, such as zinc nitrate, zinc chloride or zinc fluoroborate, but for ecological reasons they are less preferred.

Regarding catalysts, the whiteness is improved if calcium chloride, alkali metal halides and alkali metal salts of hydroxycarboxylic acids are used as co-catalysts.

In a further, advantageous variant of the process, water-soluble epoxy-containing hydrophilic silicones are added to the finishing liquors. The silicones, in addition to expoxy groups, contain polyalkylene oxide groups, which bring about the water solubility and hydrophilicity. These silicones have in general a viscosity of from 1,000 to 8,000 mPa.s. Their epoxy group content is about 0.2–4 g of epoxy groups per 100 g of silicone. Hydrophilic silicones are sufficiently well-known, so that further elucidation (see U.S. Pat. No. 4,184,004, DE Offenlegungsschrift 3,418,880 and EP Patent Application 193,402) is superfluous.

The advantages of using such silicones is that they confer a permanent soft hand on the material so treated and have a favorable effect on the crease recovery properties. Unlike textile material treated with conventional silicones, the treated material remains hydrophilic, which is frequently desirable with respect to the ability to absorb moisture. As mentioned above, these hydrophilic silicones, owing to their water solubility, are also easily incorporable in the textile treatment agents.

It will be readily understood that the finishing liquors in addition may contain further assistants customary in the textile industry, such as wetting agents, filling resins, flameproofing agents, agents for making threads slip resistant, hydrophobizing and oleophobizing agents and similar products, and also, insofar as necessary, the associated catalysts. It is also possible—if a low level of formaldehyde is accepted—to use low-formaldehyde resins based on aminoplast intermediates for further increasing the crease resist properties.

Finishing with the further textile assistants mentioned can take place with the same finishing liquor or, depending on practical requirements, alternatively with a separate liquor. The treatment with the finishing liquors can be effected by methods customary in the textile industry, for example by dipping, padding, spraying or coating. The finishing method employed also dictates the level of active constituents in the treatment medium, as will be familiar to those skilled in the art.

After the liquor has been absorbed, the textile material is dried under customary conditions and then cured at from 130° C. to 190° C., preferably at from 150° C. to 170° C., for from about ½ minute to about 15 minutes. It is advisable to subject the treated textile material to a brief wash thereafter, since this brings about an additional improvement in whiteness.

According to the claimed process, textile material which consists at least partly of cellulose or regenerated cellulose can be given a crease resist finish. The term textile material here is to be understood as meaning not only woven fabrics but also knitted fabrics and, if preconsolidated, nonwovens as well. Besides cellulose and/or regenerated cellulose fibers, the textile material may also contain other natural fibers, but in particular synthetic fibers, such as polyester, polyamide or polyacrylonitrile fibers. Of particular interest are cotton/polyester blend fabrics.

The textile material thus treated shows good wet and dry crease recovery and good shrink resistance. It is particularly noteworthy that the whiteness is appreciably better than that of the prior art. It was unforeseeable that dialkyldihydroxyimidazolidinones which have been known for more than 20 years as agents for crease resist finishing of cellulose containing textile material (U.S. Pat. No. 3,112,156) could be improved in utility as regards whiteness by the use of selected polyhydric alcohols to such an extent that the preservation of whiteness approaches those values obtainable with conventional aminoplast resins, for example dimethyloldihydroxyimidazolidinone.

The whiteness is determined in accordance with a formula developed by GANZ (cf. the publication "Methoden und Einsatzmöglichkeiten der farbmetrischen Weissbewertung von Textilien" by R. Griesser, CIBA-GEIGY Brochure No. 9140 D (edition 1981); see also Textilveredlung 18 (1983), No. 5, pages 157–162).

Proven apparatus for these investigations is the "ELREPHO 2000 spectrophotometer for reflectance measurements" from DATACOLOR. It has again been found in this connection, as is common knowledge among those skilled in the art, that the results obtainable are dependent on the fluorescent whitening agents (FWAs) used, with the FWA formulation likewise entering into the result, in particular at higher curing temperatures.

The present invention is described in more detail by reference to the following examples, where parts and percentages are by weight.

FINISHING AGENT A

This finishing agent contains 37,5% of 1,3-dimethyl-4,5-dihydroxyimidazolidinone 20% partially etherified with methanol (calculated as solid), of 1,1,1-tris(hydroxymethyl) ethane and 42,5% of water.

FINISHING AGENT B

Same as A), except that the tris(hydroxymethyl)ethane is replaced by the same amount of 1,6-hexanediol.

FINISHING AGENT C (COMPARISON)

Same as A), except that the tris(hydroxymethyl)ethane is replaced by the same amount of diethylene glycerol.

FINISHING AGENT D (COMPARISON)

Same as A), except that the tris(hydroxymethyl)ethane is replaced by the same amount of glycerol.

EXAMPLE 1

The finishing agents A to D were used to prepare aqueous liquors each containing per liter 200 g of the agent and also 24 g of magnesium chloride hexahydrate and 0,3 g of sodium fluoroborate (liquors 1 A to 1 D). These liquors were used to impregnate a cotton poplin (weight 110 g/m$^2$) previously FWA-treated with 3,4 g/l of ®UVITEX MST 300% (CIBA-GEIGY AG), and the material is squeezed to a liquor pick-up of 65% and dryed at 100° C. for 10 minutes.

The finished fabric samples obtained were each divided into 4 sections which were then subjected, for the purpose of curing, to the action of higher temperatures under various conditions, namely 7 minutes at 130° C. (T1), 5 minutes at 150° C. (T2), 2 minutes at 170° C. (T3) and 45 seconds at 190° C. (T4). Thereafter the whiteness was measured by the Ganz method, which is described in the cited references (see page 10, line 8 et seq. of the description).

The results are summarized in Table I below.

TABLE I

| | Liquor fabric | | | | |
|---|---|---|---|---|---|
| condition | 1 A | 1 B | 1 C (comp.) | 1 D (comp.) | FWA-treated |
| T 1 | 205 | 206 | 199 | 196 | 189 |
| T 2 | 194 | 192 | 178 | 182 | 185 |
| T 3 | 169 | 165 | 143 | 151 | 182 |
| T 4 | 145 | 136 | 115 | 118 | 176 |

The table clearly shows the superiority on using the polyhydric alcohols selected according to the invention in terms of reduced yellowing at the curing temperature even at a temperature as low as 130° C. (T1).

EXAMPLE 2

200 g of 1,3-dimethyl-4,5-dihydroxyimidazolidinone are mixed with 120 g of water and 90 g of 1,6-hexanediol, 10 g of acetic acid (60%) are added, and the mixture is heated at 45° C. for two hours. It is then neutralized with sodium hydroxide solution and adjusted with water to a solids content of about 63%. Of the 1,6-hexanediol used, about a quarter has become bound by etherification.

160 g of this product are admixed with 24 g of magnesium chloride hexahydrate and 0,3 g of sodium fluorborate and made up with water to one liter.

The whiteness values, measured on cotton poplin (see example 1), FWA-treated with 10 g/l of UVITEX MST liquid new (Ciba-Geigy AG) are 209 for T1, 196 for T2, 177 for T3 and 155 for T4, while the dry crease recovery angle measured in accordance with German Standard Specification DIN 53890 is 218°.

EXAMPLE 3

In line with Example 2, 200 g of 1,3-dimethyl-4,5-dihydroxyimidazolidinone are admixed with 120 g of water and 90 g of ethanol, 10 g of 60% strength acetic acid were added and the mixture is heated at 45° C. for 2 hours. It is then neutralized with 50% strength sodium hydroxide solution, excess ethanol is distilled off, and the residue is adjusted with water to a solids content of about 46% (degree of etherification about 10%).

Finishing liquor:

160 g/l of the above product,
40 g/l of 1,6-hexanediol
24 g/l of $MgCl_2 \cdot 6H_2O$ and
0.3 g/l of sodium fluoroborate.

Finishing gives the following results:

TABLE V

| T 1 | T 2 | T 3 | T 4 |
|---|---|---|---|
| 201 | 189 | 170 | 151 |

We claim:

1. An aqueous textile treatment agent containing effective amounts of a 1,3-dialkyl-4,5-dihydroxyimidazolidinone whose hydroxyl groups may be wholly or partly etherified with a low monohydric alcohol, and 2-methyl-2,4-pentanediol or a polyhydric alcohol of the general formula $$RCH(OH)—(CH_2)y—CH(OH)—R' \quad \text{I a)}$$

where R and R' are independently of each other H or $CH_3$ and y is from 1 to 4 or $$R''—C(CH_2OH)_3 \quad \text{I b)}$$

where R'' is alkyl with 1 or 3 carbon atoms, wherein said imidazolidinone may be at least partially etherified with the polyhydric alcohol of the general formula I a) or I b).

2. The aqueous textile treatment agent according to claim 1, wherein the polyhydric alcohol of the formula I a) or I b) is 1,6-hexanediol or 1,1,1-tris-(hydroxymethyl)ethane.

3. The aqueous textile treatment agent according to claim 1, which additionally contains a water-soluble epoxy-containing hydrophilic silicone.

4. A process for the crease resist finishing of textile material consisting at least partly of cellulose or regenerated cellulose fibers which comprises treating said material with an aqueous liquor containing effective amounts of a 1,3-dialkyl-4,5-dihydroxyimidazolidinone whose hydroxyl groups may be wholly or partly etherified with a low monohydric alcohol, 2-methyl-2,4-pentanediol or a polyhydric alcohol of formula I a) or I b) and a customary catalyst, drying, heating and finalizing in a conventional manner, wherein the aqueous liquor contains 2-methyl-2,4-pentanediol or a polyhydric alcohol of the general formula I a) or I b) as defined in claim 1 as such or at least partially etherified with the imidazolidinone.

5. The process according to claim 4, wherein the dialkyldihydroxyimidazolidinone in the liquor is 1,3-dimethyl-4,5-dihydroxyimidazolidinone.

6. The process according to claim 4, wherein the dialkyldihydroxyimidazolidinone is partially etherified with methanol.

7. The process according to claim 4 wherein the dialkyldihydroxyimidazolidinone present in the liquor is at least partially etherified with 1,6-hexanediol or 1,1,1-tris(hydroxymethyl)ethane as the polyhydric alcohol of the formula I a) or I b).

8. The process according to claim 4 wherein the liquor contains 1,6-hexanediol as compound I a).

9. The process according to claim 4, wherein the liquor additionally contains a water-soluble epoxy-containing hydrophilic silicone.

10. The process according to claim 4, wherein the liquor contains a magnesium salt as a catalyst.

11. The process according to claim 10, wherein the catalyst is boosted with a fluoroborate.

12. The process according to claim 4, wherein after heating the textile material is additionally washed.

13. The process according to claim 4, wherein the aqueous liquor contains a further assistant known for textile finishing.

* * * * *